United States Patent [19]

Paskerian

[11] Patent Number: 4,724,580

[45] Date of Patent: Feb. 16, 1988

[54] HINGE WITH OFFSET GUIDE WALLS

[75] Inventor: Wayne H. Paskerian, Winchester, Mass.

[73] Assignee: M. W. Carr & Co. Inc., Somerville, Mass.

[21] Appl. No.: 759,409

[22] Filed: Jul. 26, 1985

[51] Int. Cl.[4] ..... E05D 5/10

[52] U.S. Cl. ..... 16/386; 16/355; 16/DIG. 29

[58] Field of Search ..... 16/386, 382, 355, 356, 16/DIG. 29, 335, 262, 257, 259; 248/475.1

[56] References Cited

U.S. PATENT DOCUMENTS 889,539 6/1908 Morg ..... 16/257

2,857,618 10/1958 Jordan ..... 16/335

*Primary Examiner*—Frederick R. Schmidt

*Assistant Examiner*—Maurina Rachuba

[57] ABSTRACT

A hinge having a pair of hinge plates which are reasonably connectable to each other for limited relative rotation. Each plate includes a generally flat base portion and a connecting portion disposed at an end of the base portion. The connecting portion of one of the hinge plates comprises a socket extending generally transverse of the base portion. The socket is defined in part by the flat base portion and in part by a socket wall connected at one end thereof to the base portion. The other end of the socket wall is a free end that faces generally towards and is spaced slightly from the base portion. The connecting portion of the other hinge plate is generally flat and includes a first portion that extends generally side to side of the hinge plate and is sized and adapted to fit within the socket, and a second portion intermediate the first portion and the base portion that defines a cut-out for receiving the free end of the socket wall of the one hinge plate. The gap between the free end of the one hinge plate and the base portion thereof is less than the thickness of the first portion of the connecting portion of the other hinge plate.

24 Claims, 4 Drawing Figures

HINGE WITH OFFSET GUIDE WALLS

This invention relates to hinges and, more particularly, to easel hinges.

BACKGROUND OF INVENTION

Hinges permitting limited relative angular movement of their plates are known in the art. Such hinges are used, for example, as easel hinges to connect the backs and support legs of picture frames.

U.S. Pat. No. 2,857,618 to R. O. Jordan discloses a hinge in which the two hinge plates may be maintained in a number of relative angular positions.

U.S. Pat. Nos. 3,994,045, 4,050,107 and 4,349,932, all in the name of Leo T. Roy, disclose easel hinges in which both hinge plates terminate in curved barrels, the barrel of the hinge plate attached to the support leg being within that of the hinge plate attached to the picture frame back.

Hinges such as those disclosed in the above-referenced patents have drawbacks and limitations. For example, use of the picture frame is limited by the fact that the two hinge plates are essentially permanently attached to each other.

SUMMARY OF INVENTION

A principal object of the present invention is to provide an easel hinge construction which permits the hinge plate to which the support leg is attached easily to be snapped into and out of engagement with the hinge plate connected to the picture frame back, so that the picture frame may either stand by itself as an easel or, with the support leg removed, be hung on a wall. Other objects include providing such a hinge which permits the top of the support leg directly to abut the picture frame back, thereby contributing to overall strength and stability of the unit, and which can be easily and inexpensively manufactured.

The invention features a hinge having a pair of hinge plates which are removably connectable to each other for limited relative rotation. Each of the hinge plates includes a base portion and a connecting portion disposed at an end of the base portion. The connecting portion of one of the hinge plates comprises a socket extending generally transverse of the base portion. The socket is defined in part by the base portion and in part by a socket wall one end of which is connected to the base portion. The other end of the socket wall is a free end that faces generally towards and is spaced slightly from the base portion. The connecting portion of the other hinge plate includes a first portion that extends generally side to side thereof and is sized and adapted to fit within the socket, and a second portion, intermediate the first portion and the base portion thereof, that defines a cut-out for receiving the free end of the socket wall of the one hinge plate. The gap between the free end of the socket wall and the base portion of the one hinge plate is less than the thickness of the first portion of the connecting portion of the other hinge plate, and the socket wall is flexible in response to force applied to the free end by the connecting portion of the other hinge plate so that the free end will move away from the one hinge plate base and permit the other hinge plate connecting portion to be snapped into and out of the socket.

In preferred embodiments, the socket is generally triangular, the base portion of both plates are generally flat, the one hinge plate includes a pair of guide walls at the longitudinal edges thereof spaced apart a distance slightly greater than the width of the connecting portion of the other hinge plate, and the connecting portion and base portion of the other hinge plate are offset so that, when the hinge is open, a support leg connected to the other hinge plate base portion will abut a backing to which the one hinge plate is attached.

DESCRIPTION OF PREFERRED EMBODIMENT

Figure 1:
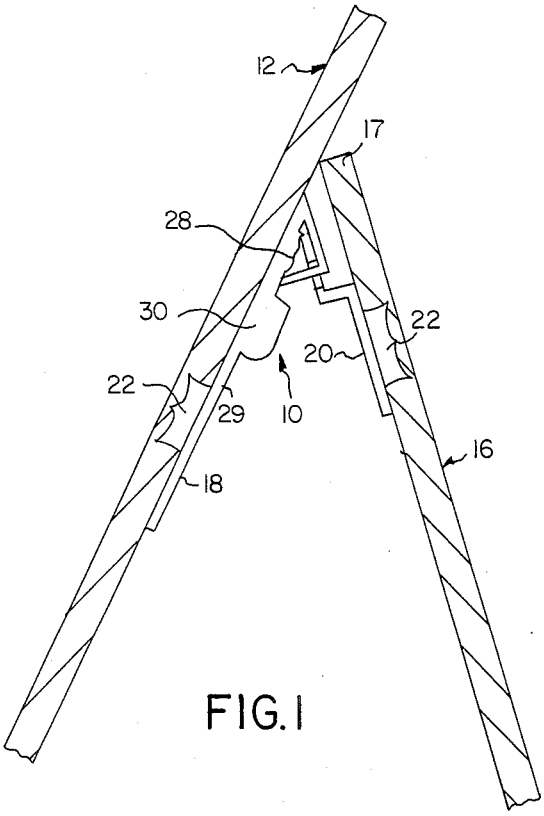
FIG. 1 is a plan sectional view of an easel hinge embodying the present invention, applied to the backing of an easel type picture frame.

Referring now to the drawings, FIG. 1 shows an easel hinge, generally designated 10, connecting the backing 12 of a picture frame to the picture frame support leg 16. Support leg 16 and backing 12 are typically formed of of wood, paperboard, cardboard, styrene or the like. The easel hinge 10 includes an inner hinge plate 18 and an outer hinge plate 20, both of which are stamped from sheets of 0.025 inch thick cold-rolled steel and are folded into the final configurations shown. In the illustrated embodiment, both hinge plates are provided with conventional rosettes 22, which project from the outer side of the respective hinge plate and attach the respective hinge plate to the backing 12 or support leg 16 in the usual manner. In the other embodiments, holes may be punched through the hinge plates and the plates then secured to the backing and support leg by some other means, such as rivets.

Figure 3:
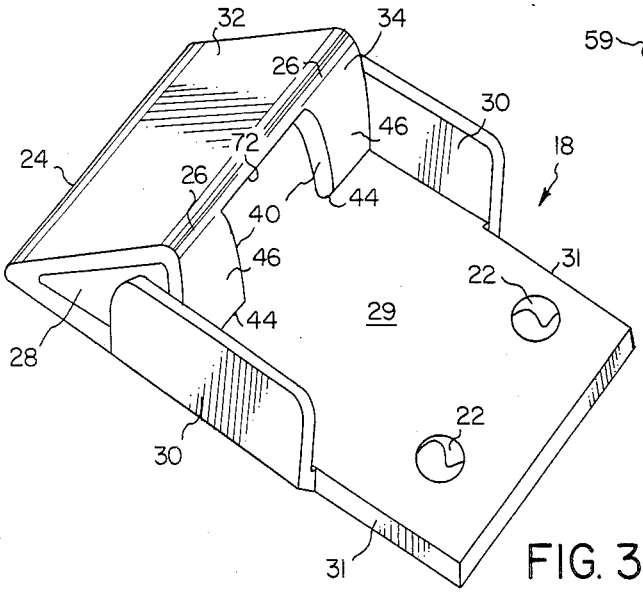
FIG. 3 is a perspective view of one of the hinge plates of the hinge of FIG. 1.

As finally configured, and shown most clearly in FIG. 3, inner hinge plate 18 comprises a flat base 29 having a generally triangular in cross-section socket 28 at one end thereof, and a pair of guide walls 30 extending along the opposite sides 31 of base 29 from midway the length of the respective side to approximately the middle of the adjacent side of socket 28. Guide walls 30 are perpendicular to base 29, have a height slightly less than that of socket 28, and are generally parallel to each other. Preferably, the lines along which the flat sheet is folded to provide guide walls 30 diverge slightly (e.g., each diverges about 1° from the respective side 31 of base 29, the total included angle being not more then about 2°), so that the walls 30 themselves diverge and provide a slight draft to assist in guiding the two hinge plates together.

Socket 28 is formed by bending the top end portion of inner hinge plate along fold lines 24 (at the end of base 29) and 26 (parallel to line 24) to provide a pair of relatively inclined socket side walls 32 and 34, both of which also are inclined relative to base 29. Socket side wall 32 is approximately 0.125 inch wide (distance between fold lines 24 and 26) and forms an approximately 40 degree included angle with base 29, to which it is attached along fold line 24. Side wall 34 forms an approximately 70 degree included angle with side wall 32, to which it is attached along fold line 26, has a free end 44 spaced slightly above base 29, is about 0.090 inch wide (distance between fold line 26 and free end 44), and is rolled rather than flat so that it lies on a 0.125 inch radius from fold line 24

The central portion of socket side wall 34 is removed, forming a generally rectangular opening 40 extending the full height of side wall 34 (i.e., from free end 44 to fold line 26) and a remaining portion or tab 46 on each side thereof. The free ends 44 of the tabs 46 of side wall 24 are spaced slightly from the adjacent flat surface of base 29, i.e., the gap between the slightly rounded (0.020 in. radius) lower edge of each free end 44 and base 29 is slightly less than the thickness of outer hinge plate 20. In the illustrated embodiment, the gap is about 0.023 in. In other embodiments it may range from about 0.001 to about 0.005 inches less than the thickness of the connecting portion 58 of outer hinge plate 20.

Figure 4:
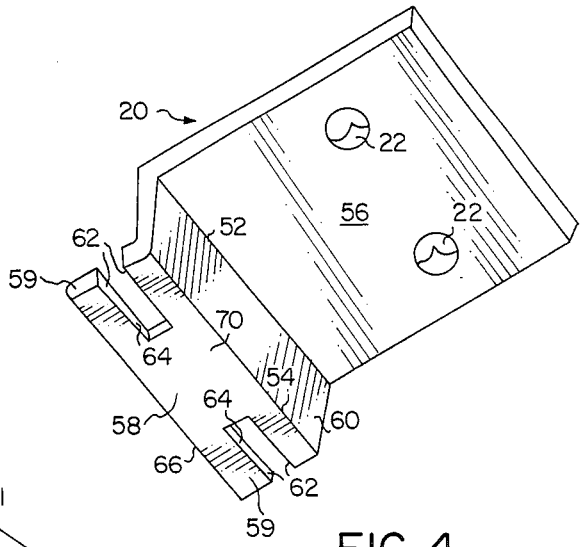
FIG. 4 is a perspective view of the other hinge plate of the hinge of FIG. 1.

Referring now to FIG. 4, outer hinge plate 20 is a flat sheet folded along a pair of parallel fold lines 52, 54 to provide a flat base, an offset connecting portion parallel to base 56, and an intermediate portion 60 extending between and perpendicular to base 56 and connecting portion 58. As shown in dashed lines in FIG. 2, connecting portion 58 is offset from base 56 a distance such that, when the hinge is closed (e.g., connecting portion 58 is in face-to-face engagement with base 29) base 56 will lie with its outer surface (i.e., the surface connected to leg 16) in a plane parallel to base 29 and even with or spaced slightly above socket 28. The overall side-to-side width of outer hinge plate 20 is slightly less than the perpendicular distance between guide walls 30 of inner hinge plate 18, to provide a close slip fit therebetween. The corners of the leading edge 66 of offset connecting portion 58 are rounded, and a pair of rectangular cut-outs 62 are provided in the opposite sides of the connecting portion. Each cut-out 62 is about $\frac{1}{8}$ inch wide (measured perpendicular to fold line 52) and 0.025 inch deep (measured perpendicular to the sides 59 of connecting portion 58), and has its leading side 64 about 0.1 inch from and parallel to the leading edge 66 of top hinge plate 16. The upper (i.e., facing away the plane of base 56) edge of leading edge 66 and the upper edges of the near sides 64 of cut-outs 62 are slightly rounded (0.020 in. radius).

Figure 2:
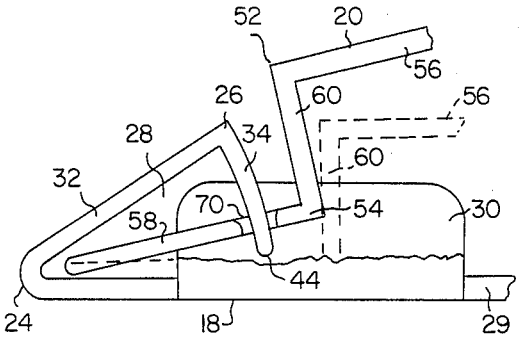
FIG. 2 is an enlarged view of portions of the hinge of FIG. 1.

In use, connecting portion 58 of outer hinge plate 20 is fitted between the side guide walls 30 of inner hinge plate 18, in face-to-face engagement with base 29, and is then snapped into place (as shown in FIGS. 1 and 2) by pushing the leading end portion of connecting portion 58 (i.e., the portion between leading edge 66 and cut-outs 62) under the free ends 44 of tabs 46 and into socket 28. Since the socket walls are flexible, particularly about fold line 24, free ends 44 move resiliently upwardly in response to the force applied to the free ends 44 by connecting portion 58, thus permitting the snapping together (and later, if so desired, apart). When the two hinge plates are so snapped together, the tabs 46 of socket wall 34 fit into cut-outs 62, thus permitting relative rotation of the two hinge plates between a closed position (shown in dashed lines in FIG. 2) in which connecting portion 58 of outer hinge plate 20 and the base 29 of lower hinge plate 18 are in face-to-face contact, and an open position (shown in FIG. 1) in which the top of the portion 70 of connecting portion 58 between cut-out 62 contact the transverse edge 72 at the top of opening 40 in socket wall.

As shown in FIG. 1, support leg 16 is connected to the outside (i.e., the side opposite inner hinge plate 20 and backing 12) of outer hinge plate 20, with its upper edge 17 spaced above the leading edge 66 of the outer hinge plate so that, when the hinge 10 is open and the picture is, for example, standing on a table, edge 17 will abut the back of backing 18.

The rounded upper leading corner of the leading edge 66 of outer hinge plate 20 facilitates snapping the hinge plates together. The rounded edges at the bottom of the tabs 46 of socket wall 34, and at the top corner of leading edges 64 of cutout 62, facilitate snapping the hinge plates apart when it is desired, for example, to remove the support leg 16 and attached outer hinge plate 20 and hang the picture on a wall.

Other embodiments will be within the scope of the following claims.

What is claimed is:

1. A hinge having a pair of hinge plates removably connectable to each other for limited relative rotation, each of said hinge plates including a base portion and a connecting portion disposed at an end of the base portion thereof;

the connecting portion of one of said hinge plates comprising a socket extending generally transversely of said base portion thereof, said socket being defined at least in part by a socket wall connected at one end thereof to said base plate and at the other end thereof having a free end facing generally towards and spaced slightly from said base portion of said one hinge plate; and, the connecting portion of the other of said hinge plates including a first portion extending generally transversely of said other hinge plate and being sized and adapted to fit within said socket, a cut-out for receiving said free end of said socket wall of said arm hinge plate, and a second portion intermediate said first portion and said base portion thereof, said socket wall being arranged such that the portion of said free end of said socket wall nearest said base portion of said one hinge plate and said base portion of said one base plate define therebetween a gap the height of which is less than the thickness of said first portion of said connecting portion of said other hinge plate;

said free end being movable away from said base portion of said one hinge plate in response to force applied thereto by said other hinge plate whereby said connecting portion of said other hinge plate may be snapped into and out of said socket, said one hinge plate including a pair of generally parallel guide walls, one of said guide walls being provided at each side of said one hinge plate, each of said walls extending from adjacent said socket towards the end of said hinge plate most distant from said socket, and the distance between said guide walls being slightly greater than the width of said connecting portion of said other hinge plate so as to provide a slip fit between said guide walls and said other hinge plate connection portion, and said guide walls diverging slightly from such other such that the distance between said walls at the ends thereof nearer said socket is less than the distance therebetween at the ends thereof most distant from said socket.

2. The hinge of claim 1 wherein each of said base portions is generally flat and said socket of said one hinge plate is defined in part by said flat base portion of said one hinge plate.

3. The hinge of claim 1 wherein the included angle between said guide walls is not more than about 2°.

4. The hinge of claim 1 wherein the portion of said socket wall most distant from said one end thereof includes an opening therein extending generally upwardly from said free end thereof, the upper edge of said opening being generally parallel to said base portion and defining a stop for limiting relative rotation of said hinge plates.

5. The hinge of claim 1 wherein the portion of said socket wall most distant from said one end thereof includes an opening therein generally midway the transverse width of said other hinge, said opening extending upwardly from said free end of said socket wall and said socket wall including tabs at either side of said opening, the lower edges of each of said tabs defining a said free end.

6. The hinge of claim 1 wherein said socket is generally triangular in cross-section.

7. The hinge of claim 6 wherein said socket wall includes a first wall portion connected at one end thereof to said base portion and inclined at an angle of about 40 degrees relative to said base portion, and a second wall portion connected to said first wall portion and inclined relative to both said base portion and said first wall portion.

8. The hinge of claim 7 wherein said second wall portion is inclined at an angle of about 70 degrees relative to said first wall portion.

9. The hinge of claim 6 wherein said socket wall includes a first wall portion connected at one end thereof to said base portion and inclined at an angle relative to said base portion, and a second wall portion connected to said first wall portion and inclined relative to both said base portion and said first wall portion, said second wall portion being curved in cross-section such that said wall lies on a radius from the line along which said first wall portion is connected to said base portion.

10. The hinge of claim 1 wherein said distance between said portion of said free end of said socket wall and said base portion of said one hinge plate is in the range of 0.001 to 0.005 inches less than the thickness of said connecting portion of said other hinge plate.

11. The hinge of claim 1 wherein a leading edge of said connecting portion of said other hinge plate is rounded to facilitate snapping said connecting portion of said other hinge plate into said socket of said one hinge plate.

12. The hinge of claim 1 wherein the edge of said free end of said free end of said socket wall nearer said one end of said base portion of said one hinge plate is rounded to facilitate snapping said connecting portion of said other hinge plate out of said socket of said one hinge plate.

13. The hinge of claim 1 wherein an edge of said cut-out of said connecting portion of said other hinge plate nearer the leading end of said connecting portion is rounded to facilitate snapping said connecting portion of said other hinge plate out of said socket of said one hinge plate.

14. A hinge having a pair of hinge plates removably connectable to each other for limited relative rotation, each of said hinge plates including a base portion and a connecting portion disposed at an end of the base portion thereof;

the connecting portion of one of said hinge plates comprising a socket extending generally transversely of said base portion thereof, said socket being defined at least in part by a socket wall connected at one end thereof to said base plate and at the other end thereof having a free end facing generally towards and spaced slightly from said base portion of said one hinge plate;

the connecting portion of the other of said hinge plates including a first portion extending generally transversely of said other hinge plate and being sized and adapted to fit within said socket, a cut-out for receiving such free end of said socket wall of said arm hinge plate, and a second portion intermediate said first portion and said base portion thereof; and said socket wall being arranged such that the portion of said free end of the socket wall nearest said base portion of said one hinge plate and said base portion of said one hinge plate define therebetween a gap the height of which is less than the thickness of said first portion of said connecting portion of said other hinge plate, said free end being movable away from said base portion of said one hinge plate in response to force applied to said socket wall by said other hinge plate whereby said connecting portion of said other hinge plate may be snapped into and out of said socket, and said base portion and said connecting portion of said other hinge plate being parallel to and offset from each other such that, when said connecting portion of said other hinge plate engages said base portion of said one hinge plate and said base portions of said hinge plates are substantially parallel to each other, the surface of said base portion of said other hinge plate most distant from said one hinge plate will be substantially coplanar with or above said one hinge plate whereby members may be connected to said hinge plates such that the said member connected to said other hinge plate may extend over the top of said socket and the end of one of the members may abut the other of said members when said hinge plates are rotated apart.

15. The hinge of claim 12 wherein said socket wall includes a first wall portion connected at one end thereof to said base portion and inclined at an angle relative to said base portion, and a second wall portion connected to said first wall portion and inclined relative to both said base portion and said first wall portion.

16. The hinge of claim 15 wherein said first wall portion is inclined at an angle of about 40 degrees relative to said base portion, said second wall portion is inclined at an angle of about 70 degrees relative to said first wall portion, and said second wall portion is curved in cross-section such that said wall lies on a radius from the line along which said first wall portion is connected to said base portion.

17. The hinge of claim 15 wherein said second wall portion includes an opening therein generally midway the transverse width of said one hinge portion, said opening extending upwardly from said free end of said second wall portion and said second wall portion including tabs at either side of said opening the lower edges of which define said free end thereof.

18. The hinge of claim 17 wherein said connecting portion of said other hinge portion includes a pair of said cut-out portions, one of said cut-out portions being disposed at each longitudinal edge of said other hinge in position for receiving one of said tabs when said hinge portions are snapped together.

19. A hinge having a pair of hinge plates removably connectable to each other for limited relative rotation, each of said hinge plates including a generally flat base portion and a connecting portion disposed at an end of the base portion thereof;

the connecting portion of one of said hinge plates comprising a generally triangular in transverse cross-section socket extending generally transversely of said base portion, said socket being defined in part by said flat base portion and in part by a socket wall generally spaced above said base portion, said socket wall being connected at one end thereof to said base plate and at the other end thereof having a free end facing generally towards and spaced from said base portion thereof to, said socket wall being arranged such that the portion of said free end nearest said base portion and said base portion define therebetween a gap the height of which is slightly less than the thickness of said first portion of said connecting portion of said other hinge plate;

the connecting portion of the other of said hinge plates including a first portion extending generally transversely of said other hinge plate and being sized and adapted to fit within said socket, a cut-out for receiving said free and of said socket wall of said one hinge plate and a second portion intermediate said first portion and said base portion thereof, the connecting portion and the base portion of said other hinge plate being parallel to and offset from each other such that, when said connecting portion of said other hinge plate engages said base portion of said one hinge plate and said base portions of said hinge plates are substantially parallel to each other, the surface of said base portion of said other hinge plates most distant from said one hinge plate will be coplanar with or above the top of said socket whereby members may be connected to said hinge plates such that the said member connected to said other hinge plate may extend over the top of said socket and the end of one of the members may abut the other of said members when said hinge plates are rotated apart; and said one hinge plate including a pair of generally parallel guide walls, one of said guide walls being provided at each side of said one hinge plate, each of said walls extending from adjacent said socket towards the end of said hinge plate most distant from said socket, and the distance between said guide walls being slightly greater then the width of said connecting portion of said other hinge plate so as to provide a slip fit between said guide walls and said other hinge plate connection portion.

20. A hinge having a pair of hinge plates removably connectable to each other for limited relative rotation, each of said hinge plates including a generally flat base portion and a connecting portion disposed at an end of the base portion thereof;

the connecting portion of one of said hinge plates comprising a generally triangular in transverse cross-section socket extending generally transversely of said base portion, said socket being defined in part by said flat base portion and in part by a socket wall generally spaced above said base portion, said socket wall being connected at one end thereof to said base plate and at the other end thereof having a free end facing generally towards and spaced from said base portion thereof to, said socket wall being arranged such that the portion of said free end nearest said base portion and said base portion define therebetween a gap the height of which is slightly less than the thickness of said first portion of said connecting portion of said other hinge plate;

the connecting portion of the other of said hinge plates including a first portion extending generally transversely of said other hinge plate and being sized and adapted to fit within said socket, a cut-out for receiving said free end, of said socket wall of said one hinge plate and a second portion intermediate said first portion and said base portion thereof, the connecting portion and the base portion of said other hinge plate being parallel to and offset from each other such that, when said connecting portion of said other hinge plate engages said base portion of said one hinge plate and said base portions of said hinge plates are substantially parallel to each other, the surface of said base portion of said other hinge plates most distant from said one hinge plate will be coplanar with or above the top of said socket whereby members may be connected to said hinge plates such that the said member connected to said other hinge plates may extend over the top of said socket and the end of one of the members may abut the other of said members when said hinge plats are rotated apart, said one hinge plate including a pair of generally parallel guide walls, one of said guide walls being provided at each side of said one hinge plate, each of said wall extending from adjacent said socket towards the end of said hinge plate most distant from said socket, and the distance between said guide walls being slightly greater than the width of said connecting portion of said other hinge plate so as to provide a slip fit between said guide walls and said other hinge plate connection portion, and, said guide walls diverging slightly from each other such that the distance between said walls at the ends thereof nearer said socket is less than the distance therebetween at the ends thereof most distant from said socket.

21. In combination:

a backing for a picture frame;

a support leg for said picture frame; and a hinge having a pair of hinge plates removably connectable to each other for limited relative rotation, each of said hinge plates including a base portion and a connecting portion disposed at an end of the base portion thereof, the base portion of one of said hinge plates being connected to said backing and the base portion of the other of said hinge plates being connected to said support leg, and said hinge plates being rotatable between a closed position thereof in which said base portions of said hinge plates are generally parallel to each other and an open position thereof in which said base portions of said hinge plates are inclined relative to each other;

the connecting portion of said one hinge plate comprising a socket extending generally transversely of said base portion thereof, said socket being defined at least in part by a socket wall connected at one end thereof to said base plate and at the other end thereof having a free end facing generally towards and spaced from said base portion of said one hinge plate, said socket wall being arranged such that the portion of said free end nearest said base portion and said base portion define therebetween a gap the height of which is slightly less than the thickness of said first portion of said connecting portion of said other hinge plate;

the connecting portion of the other of said hinge plates including a first portion extending generally transversely of said other hinge plate and being sized and adapted to fit within said socket, a cut-out for receiving said free end of said socket wall of said one hinge plate, and a second portion intermediate said first portion and said base portion thereof, said connecting portion including a cut-out for receiving said free end of said socket wall of said one hinge plate; and, said one hinge plate including a pair of generally parallel guide walls, one of said guide walls being provided at each side of said one hinge plate, each of said walls extending from adjacent said socket towards the end of said one hinge plate most distant from said socket, and the distance between said guide walls being slightly greater than the width of said connecting portion of said other hinge plate so as to provide a slip fit between said guide walls and said other hinge plate connecting portion; and the connecting portion and the base portion of said other hinge plate being parallel to and offset from each other and said support leg being attached to said base portion of said other hinge plate such that said support leg extends over the top of said socket and the end of said support leg abuts said backing when said hinge plates are rotated relative to each other into the open position thereof.

22. The combination of claim 21 wherein said socket is generally triangular in transverse cross-section and includes a first wall portion connected at one end thereof to, and inclined at an angle relative to said base portion and a second wall portion connected to said first wall portion and inclined relative to both said base portion and said first wall portion, said second wall portion includes an opening therein generally midway the transverse width of said one hinge portion, said opening extending upwardly from said free end of said second wall portion and said second wall portion including tabs at either side of said opening the lower edges of which define said free end thereof, and said connecting portion of said other hinge portion includes a pair of said cut-outs each of which is arranged to receive a respective one of said tabs.

23. The combination of claim 22 wherein the distance from the free end of each of said tabs to said base portion of said one hinge plate is in the range of 0.001 to 0.005 inch less than the thickness of said connecting portion of said other hinge plate.

24. A hinge having a pair of hinge plates removably connectable to each other for limited relative rotation, each of said hinge plates including a generally flat base portion and a connecting portion disposed at an end of the base portion thereof;

the connecting portion of one of said hinge plates comprising a generally triangular in transverse cross-section socket extending generally transversely of said base portion, said socket being defined in part by said flat base portion and in part by a socket wall generally spaced above said base portion, said socket wall being connected at one end thereof to said base plate and at the other end thereof having a free end facing generally towards and spaced from said base portion thereof to, said socket wall being arranged such that the portion of said free end nearest said base portion and said base portion define therebetween a gap the height of which is slightly less than the thickness of said first portion of said connecting portion of said other hinge plate;

the connecting portion of the other of said hinge plates including a first portion extending generally transversely of said other hinge plate and being sized and adapted to fit within said socket, a cut-out for receiving said free and of said socket wall of said one hinge plate and a second portion intermediate said first portion and said base portion thereof, the connecting portion and the base portion of said other hinge plate being parallel to and offset from each other such that, when said connecting portion of said other hinge plate engages said base portion of said one hinge plate and said base portions of said hinge plates are substantially parallel to each other, the surface of said base portion of said other hinge plates most distant from said one hinge plate will be coplanar with or above the top of said socket whereby members may be connected to said hinge plates such that the said member connected to said other hinge plate may extend over the top of said socket and the end of one of the members may abut the other of said members when said hinge plates are rotated apart;

said one hinge plate including a pair of generally parallel guide walls, one of said guide walls being provided at each side of said one hinge plate, each of said walls extending from adjacent said socket towards the end of said hinge plate most distant from said socket, and the distance between said guide walls being slightly greater then the width of said connecting portion of said other hinge plate so as to provide a slip fit between said guide walls and said other hinge plate connection portion; and the perpendicular distance between said connecting portion of said other hinge portion and said base portion of said other hinge portion being greater than the height of said socket and said guide walls.

* * * * *